US007985089B2

(12) United States Patent
Zhu et al.

(10) Patent No.: US 7,985,089 B2
(45) Date of Patent: Jul. 26, 2011

(54) CARD EDGE CONNECTOR HAVING CANTILEVERED ALIGNING KEY

(75) Inventors: Jian-Kuang Zhu, Kunshan (CN); Feng Xiao, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 2 days.

(21) Appl. No.: 12/621,522

(22) Filed: Nov. 19, 2009

(65) Prior Publication Data

US 2011/0039454 A1 Feb. 17, 2011

(51) Int. Cl.
*H01R 13/62* (2006.01)

(52) U.S. Cl. ..... 439/326; 439/633; 439/680

(58) Field of Classification Search ..... 439/325, 439/326, 328, 630, 633, 680, 681
See application file for complete search history.

(56) References Cited

U.S. PATENT DOCUMENTS

| | | | | |
|---|---|---|---|---|
| 6,017,248 | A * | 1/2000 | Pan et al. | 439/681 |
| 6,152,777 | A * | 11/2000 | Smith et al. | 439/633 |
| 6,159,052 | A * | 12/2000 | Meng et al. | 439/633 |
| 6,174,184 | B1 * | 1/2001 | Meng | 439/188 |
| 7,442,093 | B2 * | 10/2008 | Li et al. | 439/681 |
| 2007/0173126 | A1 * | 7/2007 | Chen et al. | 439/633 |
| 2008/0153335 | A1 * | 6/2008 | Li et al. | 439/326 |
| 2008/0176451 | A1 * | 7/2008 | Li et al. | 439/633 |
| 2008/0207058 | A1 * | 8/2008 | Zhu et al. | 439/633 |
| 2009/0291581 | A1 * | 11/2009 | Zhu et al. | 439/325 |

FOREIGN PATENT DOCUMENTS

TW M296515 8/2006

* cited by examiner

*Primary Examiner* — Ross N Gushi
(74) *Attorney, Agent, or Firm* — Andrew C. Cheng; Wei Te Chung; Ming Chieh Chang

(57) ABSTRACT

A card edge connector includes an elongated housing with a pair of latches disposed at opposite ends thereof and defining a mating groove in the housing and between said pair of latches. A first wall and a second wall are formed at opposite sides of the mating groove, on which a plurality of conductive terminals are mounted. A key protrudes into the mating groove from the first wall with a distal end sinking into the second such that the second wall can be molded in an uninterrupted manner without the joint of the key.

20 Claims, 4 Drawing Sheets

CARD EDGE CONNECTOR HAVING CANTILEVERED ALIGNING KEY

BACKGROUND OF THE INVENTION

1. Field of the Invention

The present invention relates to a card edge connector, and more particularly to a card edge connector having an aligning key cantilevered from a body thereof benefiting deformation free formation.

2. Description of the Related Art

TW Utility Patent No. 296515 issued to Ho on Mar. 21, 2006 discloses a conventional card edge connector for connecting an electrical card to a circuit board, thereby realizing electrical connection between the electrical card and the circuit board. The card edge connector includes an elongated housing with a pair of latching arms arranged at opposite ends and a mating groove defined in the housing and located between the latching arms and opened forward. The mating groove is configured by an upper wall, a lower wall and a vertical rear wall, on which a plurality of conductive terminals are received. A key is formed by a manner of protruding forward from a front face of a vertical wall and jointing with the upper and lower walls, and locates adjacent to one of the latching arms so as to ensure an anti-disorientation interengagement.

The upper wall, lower wall, rear wall and the key are formed by an one-step molding style, and the plastic material adjacent to the key may shrink unevenly as the key builds a partition in the mating groove, which will result warpage of the housing adjacent to the key and affect the coplanarity of solder tails of the conductive terminals during the soldering process. Obviously, an improved card edge connector is highly desired to overcome the aforementioned problem.

SUMMARY OF THE INVENTION

Accordingly, an object of the present invention is to provide a card edge connector which can improve the warpage of the insulating housing.

In order to achieve the object set forth, a card edge connector includes an elongated housing with a pair of latches disposed at opposite ends thereof and defining a mating groove in the housing and between said pair of latches. The mating groove is configured by a first wall, a second wall and a rear wall connecting the first and second wall, on which a plurality of conductive terminals are mounted. A key protrudes into the mating groove from the first wall with a distal end sinking into the second such that the second wall can be molded in an uninterrupted manner without the joint of the key.

Other objects, advantages and novel features of the invention will become more apparent from the following detailed description of the present embodiment when taken in conjunction with the accompanying drawings.

DETAILED DESCRIPTION OF THE INVENTION

Figure 1:
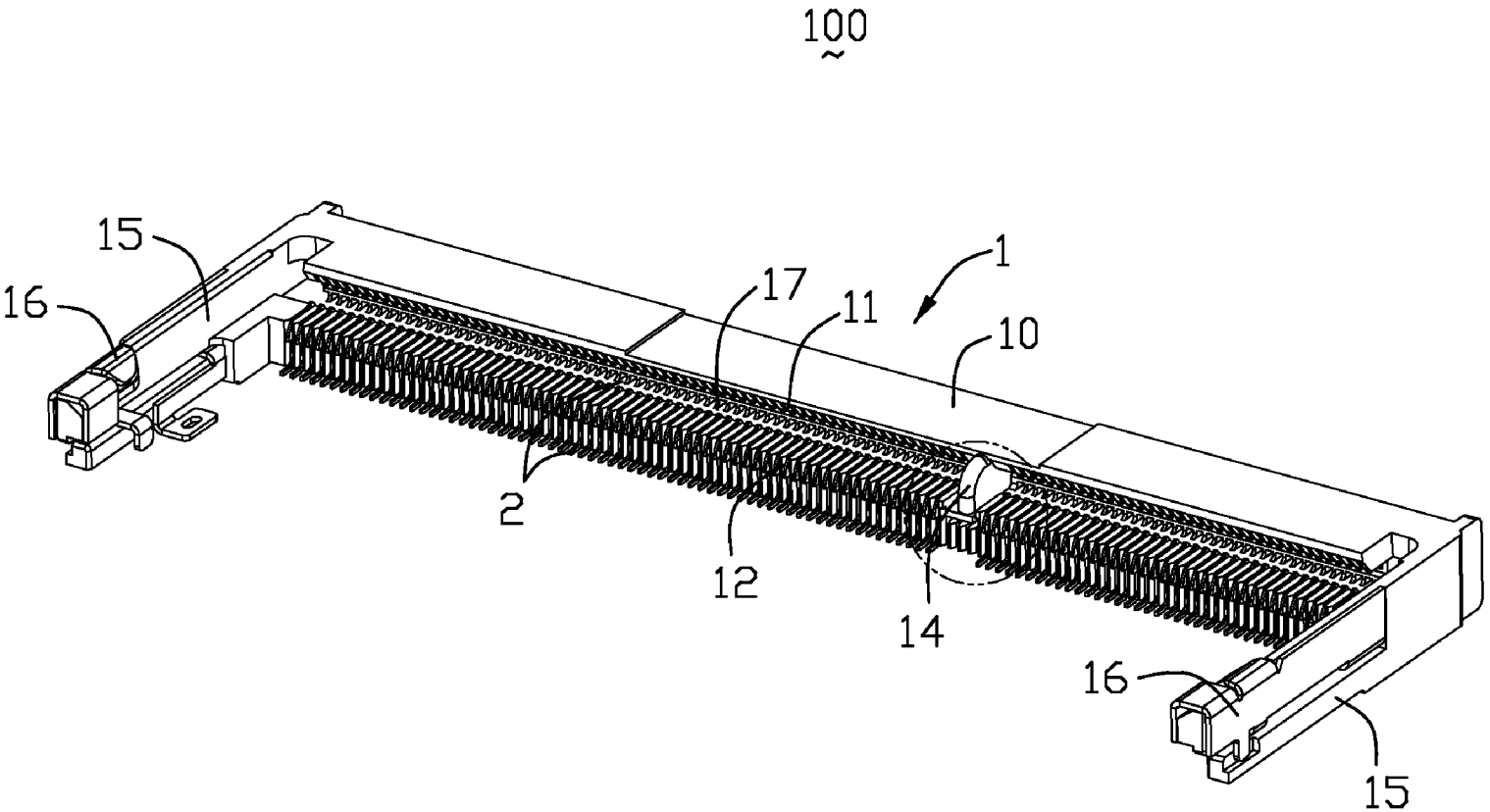
FIG. 1 is a perspective view of a card edge connector in accordance with the present invention.

Reference will now be made to the drawing figures to describe a preferred embodiment of the present invention in detail. Referring to FIG. 1, a card edge connector 100 according to the preferred embodiment of the present invention is provided and comprises an insulative housing 1 with a plurality of conductive terminals 2 received therein.

The insulative housing 1 comprises an elongated base portion 10 and a pair of arms 15 disposed at opposite ends of the base portion 10. A mating groove 17 is defined along a longitudinal direction of the base portion 10 between the pair of arms 15 and opened forwardly for receiving an electrical card therein. A pair of metallic retaining devices 16 are respectively attached onto the arms 15 for strengthening the flexibility of the arms 15 and guiding the electrical card to be inserted into the mating groove 17. An upper wall 11 and a lower wall 12 are respectively formed at opposite sides of the mating groove 17 and the conductive terminals 2 are respectively received therein with contact portions projecting into the mating groove. A key 14 is formed in the mating groove 17 adjacent to one of the arms 15 thereby dividing the mating groove 17 into two separated parts.

Figure 2:
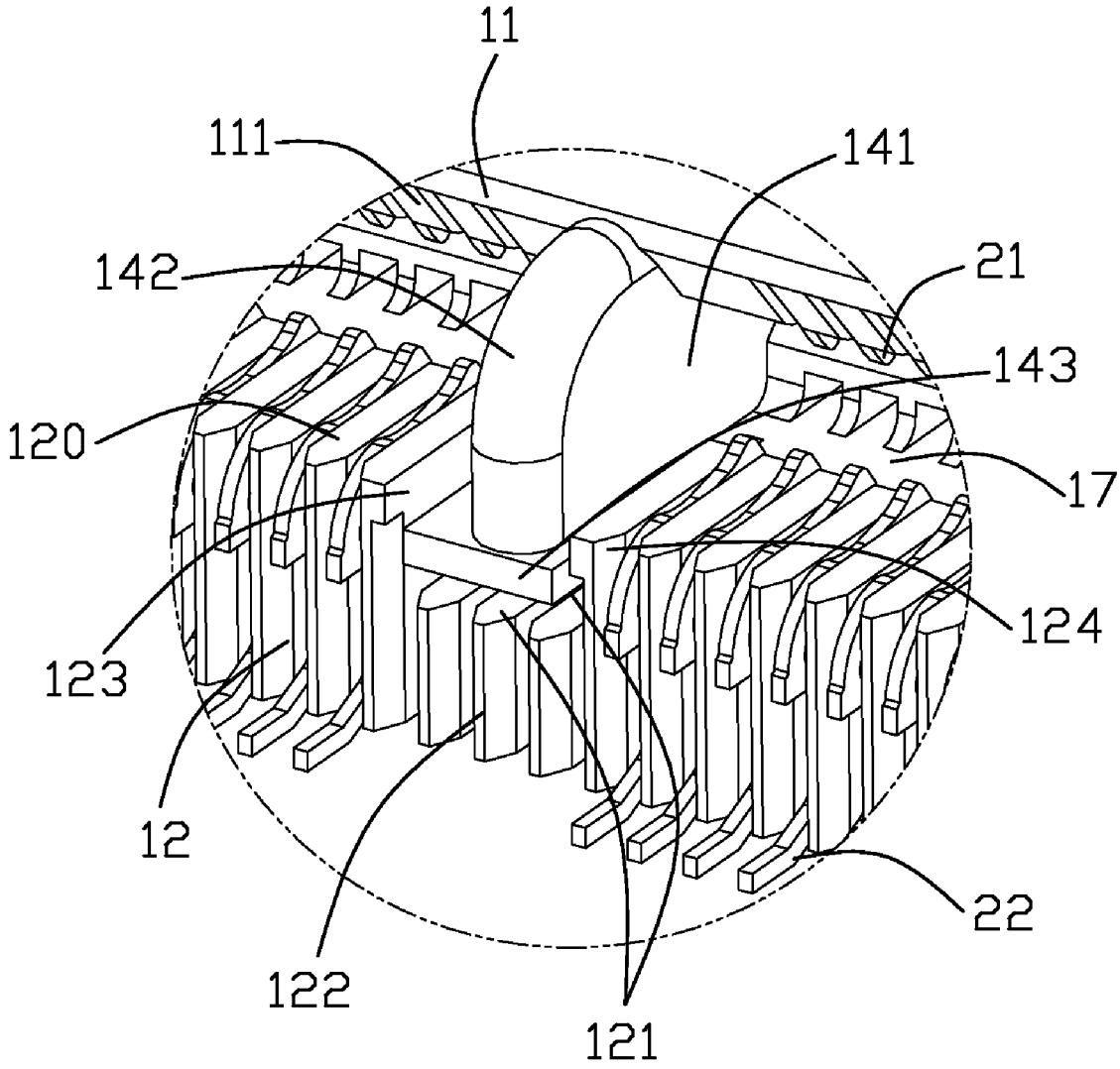
FIG. 2 is an amplified perspective view of a key of the card edge connector shown in FIG. 1.
Figure 4:
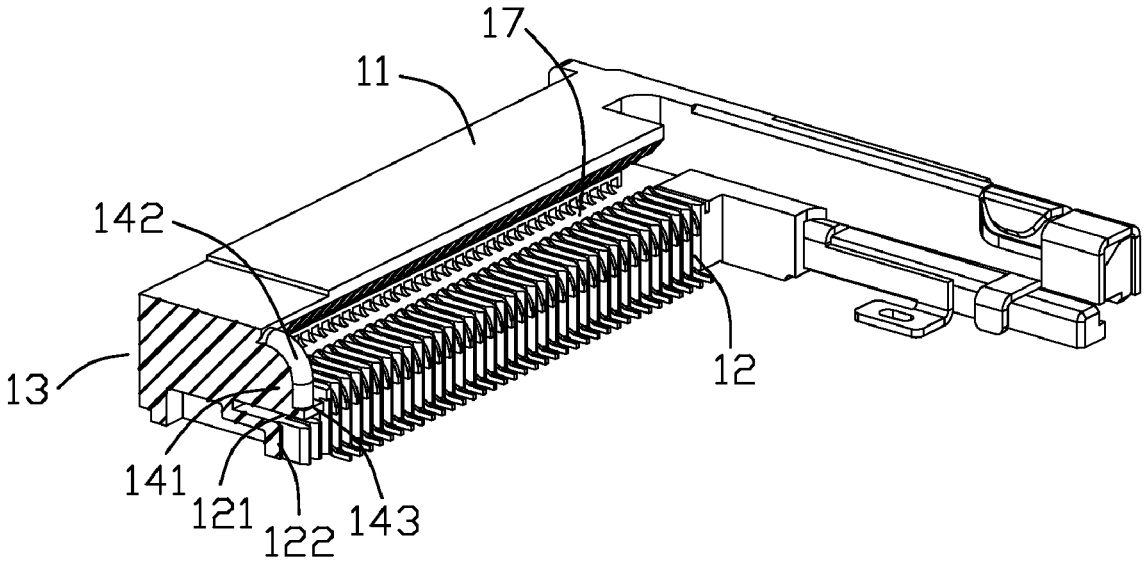
FIG. 4 is an exploded perspective view of the key shown in FIG. 2.

Referring to FIGS. 2 and 4, the extending direction of the arms 15 is defined as a mating direction. It is clearly shown that the upper wall 11 and the lower wall 12 are respectively extending from opposite sides of a rear wall 13, and the lower wall 12 is longer than the upper wall 11 in the mating direction thereby forming a step configuration for facility the insertion of the electrical card. An inclining guiding surface 111 is formed in the upper wall 11 for guiding the electrical card to be inserted into the mating groove 17. The conductive terminals 2 are divided into a row of upper terminals 21 and a row of lower terminals 22 and respectively received in the upper wall 11 and lower wall 12 for electrically contacting with the electrical card.

The key 14 is in an upended T shape in a front view and comprises a body portion 141 unitarily extending forward from the rear wall 13 of the base portion 10, an arc guiding portion 142 at a front surface of the base portion 10 and a cantilevered portion 143 extending from a lower edge of the body portion 141. The cantilevered portion 143 is thicker than the base portion 10 in the longitudinal direction so as to increase the rigidity of the key 14. In the present invention, the key 14 connects with the upper wall 11 from the rear wall 13 and ended at the guiding surface 111 of the upper wall 11, therefore the rigidity of the key 14 can be ensured. The cantilevered portion 143 of the key 14 is spaced away from the lower wall 12, which is preferable for the molding process of the insulative housing 1. The arc guiding portion 143 defines a smooth surface, on which a notch defined on the electrical card slides toward a horizontal level.

The lower wall 12 of the base 10 defines an inner surface 120 facing the mating groove 17 along the longitudinal direction. A recess 121 is defined by sinking downward from the inner surface 120, which is right under the key 14. The recess 121 comprises a supporting board 122 at a bottom face of the recess 12, and a first partition 123 and a second partition 124 located at opposite sides of the supporting board 122. Moreover, an upper surface of the first and second partitions 123, 124 is substantially the inner surface 120 of the lower wall 12.

Figure 3:
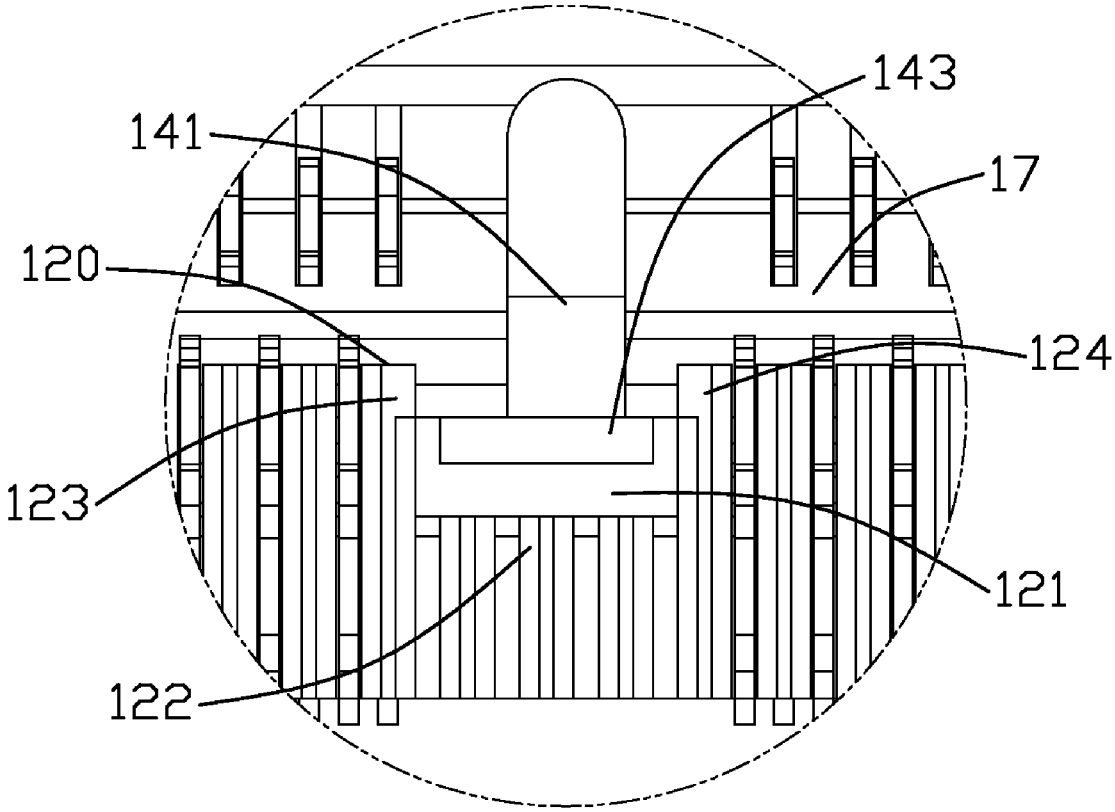
FIG. 3 is a front view of the key shown in FIG. 2.

Referring to FIGS. 2 and 3, the key 14 is corresponding with the recess 121 with the body portion 141 of the key 14 partly sinking into the recess 121, while the cantilevered portion 143 is located between the first and second partitions 123, 124 and above the supporting board 122. That is to say, the height of the key 14 in a vertical direction is larger than that between the upper wall 11 and lower wall 12. The first and second partitions 123, 124 can prevent displacement of the key 14 so as to avoid breakage of the key. As the cantilevered portion 143 is spaced to the first and second partitions 123, 124 and supporting board 122, the lower wall 12 can be molded in a flat and uninterrupted manner, which can prevent the warpage of the housing, especially improve the position of the upper wall and lower wall adjacent to the key 14, therefore the solder portions of the upper and lower terminals 21, 22 can be kept in a coplanarity level.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A card edge connector for connecting an electrical card to a printed circuit board comprising:

an insulative elongated housing with a pair of forwardly extending latches disposed at opposite ends thereof for latching the electrical card, a mating groove defined in the housing between said pair of latches, a first wall and a second wall formed at opposite sides of the mating groove, on which a plurality of conductive terminals are mounted;

wherein an insulative key unitarily formed with the housing, protrudes into the mating groove from the first wall with a distal end sinking into the second wall such that the second wall can be molded in an uninterrupted manner without a joint of the key.

2. The card edge connector as described in claim 1, wherein the second wall defines an inner surface facing the mating groove and a recess runs through said inner surface for accommodating said key.

3. The card edge connector as described in claim 2, wherein said recess comprises a first partition and a second partition in a parallel relationship and a supporting board located therebetween, said key is positioned between the first and second partitions and spaced to said supporting board.

4. The card edge connector as described in claim 3, wherein said key comprises a body portion unitarily extending from the first wall and a cantilevered portion at distal end of the body portion, said cantilevered portion being positioned between the first and second partitions and spaced to said supporting board.

5. The card edge connector as described in claim 4, wherein said cantilevered portion is under said inner surface of the second wall.

6. The card edge connector as described in claim 4, wherein the key is in an upended T shape in a front view.

7. The card edge connector as described in claim 4, wherein a guiding portion is formed on a front side of the key and forms a smooth guiding surface.

8. The card edge connector as described in claim 1, wherein the first wall is shorter than the second wall along an extending direction of said latches, and said conductive terminals are divided into first and second terminals and respectively retained in the first wall and second wall.

9. A card edge connector comprising:

an elongated housing comprising a base portion and a pair of latches positioned at opposite ends of the base portion thereof, said base portion comprising opposite first and second walls and a mating groove between said walls; and a plurality of conductive terminals respectively retained in the first and second walls;

wherein a key extends from the first wall toward the second wall but disconnected with the second wall along a vertical direction, and a height of the key in said vertical direction is larger than that between the first and second walls in the same direction.

10. The card edge connector as described in claim 9, wherein the key is in an upended T shape and defines a cantilevered portion sinking into a recess defined on the second wall.

11. The card edge connector as described in claim 10, wherein the capacity of the recess is bigger than the volume of the suspending portion so as to form apertures therebetween.

12. A card edge connector comprising:

an elongated insulative housing defining an elongated slot along a longitudinal direction thereof with opposite first and second side walls located by two sides of the slot in a transverse direction perpendicular to said longitudinal direction;

a plurality of contacts disposed in the housing with contacting sections extending into the slot for mating with a card type module; and an alignment key adapted to be received in a notch of said card type module, unitarily formed with the housing, located in the slot at a position where no contacts are disposed, and essentially extending in a transverse plane perpendicular to said longitudinal direction;

said first side wall defining a recess in alignment with the key in said transverse direction; wherein said key defining a main body portion with opposite first and second ends in the transverse direction with the first end being spaced from the first side wall while with the second end unitarily joined with the second side wall under condition that the first end defines a cantilevered portion which extends in an outward direction perpendicular to both said transverse direction and said longitudinal direction, and is dimensioned larger than the main body of the key in said longitudinal direction and spaced from the first side wall via a gap therebetween in a front view.

13. The card edge connector as claimed in claim 12, wherein said gap is U-shaped in said front view.

14. The card edge connector as claimed in claim 12, wherein the first side wall behind the cantilevered portion with regard to he slot, defines a plurality of vertical slits.

15. The card edge connector as claimed in claim 12, wherein the cantilevered portion is located on at least one side of said main body portion in the longitudinal direction.

16. The card edge connector as claimed in claim 12, wherein said cantilevered portion extends along said longitudinal direction rather than other directions oblique to said longitudinal direction.

17. The card edge connector as claimed in claim 16, wherein said first side wall defines an inner surface facing the slot, and said cantilevered portion extends in a plane which faces the slot and is located behind said inner surface of the first side wall and away from the slot.

18. The card edge connector as clamed in claim 17, wherein during mating, said card type module is rotated from the second side wall to the first side wall with a bottom edge of the card type module is received in the slot.

19. The card edge connector as claimed in claim 12, wherein said recess receives the whole said cantilevered portion therein.

20. The card edge connector as claimed in claim 12, wherein the dimension of said key along the longitudinal direction is not less than that of an area occupied by at least three contacts along said longitudinal direction.

* * * * *